US006705415B1

(12) United States Patent
Falvey et al.

(10) Patent No.: US 6,705,415 B1
(45) Date of Patent: Mar. 16, 2004

(54) DIRECTIONAL DRILLING APPARATUS

(75) Inventors: Alistair Michael Falvey, Brixham (GB); John Willoughby Gartside, Huddersfield (GB)

(73) Assignee: Halco Drilling International Limited, Halifax (GB)

( * ) Notice: Subject to any disclaimer, the term of this patent is extended or adjusted under 35 U.S.C. 154(b) by 0 days.

(21) Appl. No.: 09/913,257

(22) PCT Filed: Feb. 11, 2000

(86) PCT No.: PCT/GB00/00452

§ 371 (c)(1),
(2), (4) Date: Jan. 14, 2002

(87) PCT Pub. No.: WO00/47860

PCT Pub. Date: Aug. 17, 2000

(30) Foreign Application Priority Data

Feb. 12, 1999 (GB) ..... 9903256

(51) Int. Cl.[7] ..... E21B 7/08

(52) U.S. Cl. ..... 175/74; 175/45; 175/304; 175/306; 175/320

(58) Field of Search ..... 175/45, 73, 74, 175/293, 296, 299, 304–306, 320

(56) References Cited

U.S. PATENT DOCUMENTS

| | | | | |
|---|---|---|---|---|
| 3,955,635 | A | 5/1976 | Skidmore | |
| RE29,526 | E * | 1/1978 | Jeter | 175/73 |
| 4,440,244 | A | 4/1984 | Wiredal | |
| 4,635,738 | A | 1/1987 | Schillinger et al. | |
| 4,674,579 | A | 6/1987 | Geller et al. | |
| 4,694,911 | A | 9/1987 | Kennedy | |
| 4,694,913 | A | 9/1987 | McDonald et al. | |
| 4,714,118 | A | 12/1987 | Baker et al. | |
| 4,726,429 | A | 2/1988 | Kennedy | |
| 4,862,976 | A | 9/1989 | Meek | |
| 4,867,255 | A | 9/1989 | Baker et al. | |
| 4,924,948 | A | 5/1990 | Chuang et al. | |
| 5,009,271 | A | 4/1991 | Maric et al. | |
| 5,052,503 | A | 10/1991 | Lof | |
| 5,427,190 | A | 6/1995 | Mo | |
| 5,467,832 | A * | 11/1995 | Orban et al. | 175/45 |
| 5,695,014 | A | 12/1997 | Jenne | |
| 5,795,991 | A | 8/1998 | Hesse et al. | |
| 6,484,819 | B1 * | 11/2002 | Harrison | 175/61 |

FOREIGN PATENT DOCUMENTS

| | | |
|---|---|---|
| EP | 0202013 | 11/1986 |
| EP | 0361805 | 4/1990 |
| EP | 0787886 | 8/1997 |
| EP | 0851090 | 7/1998 |
| EP | 0857853 | 8/1998 |
| GB | 946678 | 1/1964 |
| GB | 1268938 | 3/1972 |
| GB | 2238334 | 5/1991 |
| GB | 2333789 | 2/1999 |
| WO | WO97/49889 | 12/1997 |
| WO | WO98/05476 | 2/1998 |
| WO | WO98/58153 | 12/1998 |
| WO | WO01/06085 | 1/2001 |

* cited by examiner

*Primary Examiner*—Zakiya Walker
(74) *Attorney, Agent, or Firm*—David C. Jenkins; Arnold B. Silverman; Eckert Seamans Cherin & Mellott, LLC

(57) ABSTRACT

In a directional drilling apparatus in which a sensor/transmitter or sonde is located in one section of a drill string and an element of an adjacent section is configured to "steer" the bore drilled in a predetermined lateral direction, a device is provided for automatically ensuring correct registry or alignment of the sensor/transmitter and the steerable element, this device comprising an azimuth member on the section carrying the sensor/transmitter engageable with a reference member of the adjoining section to present, after such engagement, relative rotation of the azimuth member, which is rotatable in the section carrying it, with the sensor/transmitter, but non-rotatably connected with the sonde. The reference member or the azimuth member is resiliently displaceable axially to allow the two sections to be screwed up together.

6 Claims, 8 Drawing Sheets

DIRECTIONAL DRILLING APPARATUS

BACKGROUND OF THE INVENTION

1. Field of Invention

THIS INVENTION relates to directional drilling equipment and more particularly to directional drilling equipment utilised for forming generally horizontal passages in the ground, (usually 1 to 10 meters from the surface) for electrical or telephone cables, gas or water pipes, etc. Such directional drilling equipment is known per se. The drilling equipment is directional in the sense that the drill can be, in effect, steered to allow it to be navigated along streets or roads, for example, or under roads and rivers, without striking the foundations of buildings or water mains, gas mains or sewers.

2. Description of Related Art

Such systems are known and utilise, for example, a drill bit which is not rotationally symmetrical about its axis and/or has asymmetrically disposed fluid flushing outlets, so that material can be removed preferentially from one side of the bore being drilled whereby, in use, the end of the bore being drilled can deliberately be made to drift to one side or the other of the axis of the regions of the bore further from the end whereby the drill can be "steered". WO97/49889 discloses one example of a directional drilling arrangement. The primary mechanism for deviation in known directional drilling equipment is the out-of-balance transverse force component acting on the drill bit, and hence the drill string, caused where there is no rotation of the drill string and the bit is being forced into the medium being drilled. There is some additional nonsymmetric flushing causing preferential removal of debris from one side of the bore-hole which can also assist deviation in certain softer formations.

This transverse force component effectively causes deviation or steering of the drill and drill string in the particular azimuth direction required when the drill string is not rotating. When uniform rotation is recommenced, there is no further effective transverse force component and the drill string continues along a new straight axis (which is then a different axis from the previous one). This operation can be carried out fairly frequently to effect the desired rate of change of direction, or steering.

In conventional drilling equipment, the drilling bit has a splined shank which is received in the correspondingly splined end of an endmost tubular element (or chuck) of the drilling string, the cooperating splines preventing relative rotation between the drill bit and the chuck. Normally manufacturing techniques and convenience dictate that in such known arrangements, the arrangement of splines on the drill bit shank and the chuck is rotationally symmetrical.

BRIEF SUMMARY OF THE INVENTION

According to one aspect of the invention, there is provided drilling apparatus including a drill string terminating in a drill chuck and a drill bit detachably fitted in the drill chuck, the drill bit having a shank received in the drill chuck, the drill chuck and the drill bit shank having cooperating spleens thereon and the distribution of the said splines about the axis of the drill chuck and bit being irregular so that the drill bit can be fitted in the drill chuck in only one orientation.

Preferably the drill string incorporates a pneumatically operable hammer arranged to apply axial impact forces to the drill bit, the apparatus including first passageways for supplying compressed air to such hammer mechanism and separate second passages for applying fluid to the drill bit.

In the last-noted arrangement, separate air exhaust ports and drilling fluid discharge ports are provided on the bit.

According to yet another aspect of the invention there is provided drilling apparatus including a drill string terminating in a drill chuck and a drill bit detachably fitted in the drill chuck, the drill bit having a shank received in the drill chuck, the drill bit shank having a first splined region adjacent a head position of the drill bit and having splines cooperating with grooves between splines of an internally splined complementary portion of said chuck wherein the drill bit has a second splined region adjacent its rear end and has a spline-free band located between said first and second splined regions, and the apparatus includes a liner, adjoining the chuck and having an internal axial passage which is splined in correspondence with the second splined region, over an axial extent less than that of said spline-free band, the axial passage in said liner having, immediately behind the splined region of the liner, a region which is free of splines and has an internal diameter greater than the external diameter of the second splined region of the drill bit shank, said liner being rotatable between an angular position in which the splines thereon are in axial alignment with those in the second splined region of the chuck and an angular position in which they are out of such alignment, whereby the drill shank can be inserted in the passages of complementary cross section in the chuck and the liner, with the splines of the chuck and liner aligned with the corresponding splines of the drill bit shank, until said second splined region of the drill bit shank is within the splineless region of the liner and the end splined region of the liner is within the spline-free band of the drill bit shank, and the liner thereafter rotated so as to move its splines out of axial alignment with those of said second splined region of the drill shank, thereby preventing axial removal of the drill bit.

According to yet another aspect of the invention there is provided drilling apparatus comprising a series of elongate sections releasably interconnected end to end by interengaging screw threads, orienting means for ensuring that a first component carried by a first said section adopts a predetermined orientation with respect to a second component carried by, or forming part of, an adjoining second said section when the first and second section are screwed together, wherein said first component is rotatable with respect to said first section and wherein the first section carries a member, herein referred to for convenience as an azimuth member, which is rotatable with respect to said first section but is non-rotatable with respect to said first component, and wherein the second section carries a reference member which is fixed against rotation relative to said second component and is engageable with said azimuth member in a predetermined angular orientation relative to the azimuth member as said first and second sections are screwed together end to end, and wherein, when so engaged relative rotation about the axis of said sections, between said azimuth member and said reference member is precluded by such engagement, and wherein one of said azimuth member and said reference member is resiliently displaceable away from the other as said first and second section are screwed together, whereby during an initial phase of screwing said first and second sections together the resiliently displaced member can be displaced axially, to counteract the progressive approach of said first and second sections, as the latter are screwed together, whilst rotating relative to the other said member, until said predetermined angular orientation of the reference member with respect to the azimuth member is reached, allowing the azimuth member and reference member to engage and thereby prevent further relative rotation between the two, whereby the azimuth member, and said first member coupled thereto, will maintain said predetermined orientation relative to said second component despite further rotational movement between said first and second section during completion of the screwing together of said first and second sections.

According to a still further aspect of the invention there is provided percussion drilling bit operable when accorded only a limited range of angular movement about a longitudinal axis of the bit, and wherein the bit comprises cutting tips or inserts arranged in a series of rings or tiers concentric with said longitudinal axis, such that for a predetermined angle of rotation of the bit about said axis, the zone of action of each cutting tip or insert in each said ring or tier overlaps that of at least the adjoining cutting tips or inserts in the same ring or tier.

In the preferred embodiments of the invention, a sensing and transmitting apparatus is incorporated in the drill string, adjacent to the drill chuck, to sense and transmit to the surface information about the position and orientation of the drill bit or other drilling equipment. This apparatus can relay back to the surface readings of depth, position and angular position of the drill string. This information, inter alia, allows the angular position of the drill bit to be determined and allows the bit to be positioned at the required angle for steering in the desired direction. Sensing and transmitting apparatus capable of operating as described above is herein referred to, for convenience, as a "sonde" or as a data transmitter Preferably the sonde is mounted in the drill string via a resilient suspension arrangement to isolate the sonde from mechanical shocks.

BRIEF DESCRIPTION OF THE DRAWINGS

An embodiment of the invention is described below by way of example with reference to the accompanying drawings, in which.

DETAILED DESCRIPTION OF THE INVENTION

Figure 1A:
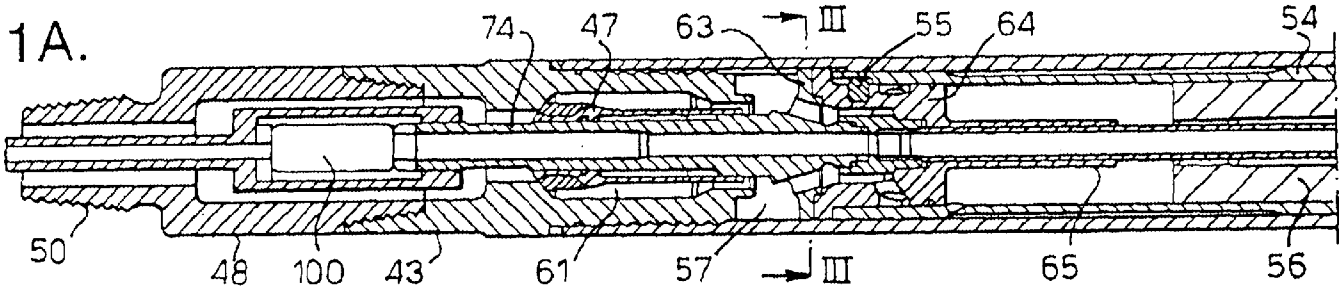
FIGS. 1A and 1B are respective parts of a view in axial section through a drill bit, chuck and associated parts of a first form of drilling assembly in accordance with the invention.
Figure 1B:
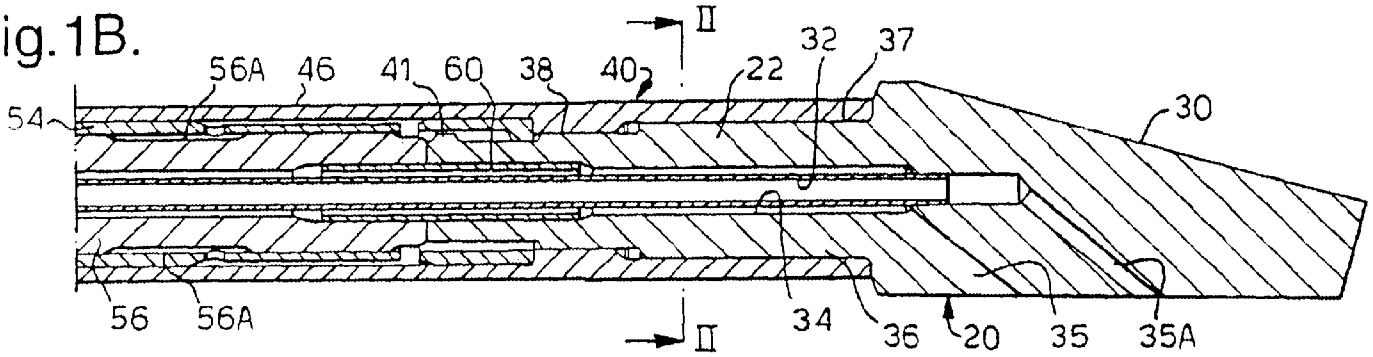

FIGS. 1A and 1B show what is in effect the operative or active portion of the drilling assembly. This is adapted to be attached, by the tapered screw-threaded stub 50 shown at the left hand side of FIG. 1A, to a so-called drill string which normally comprises a series of tubular sections connected together end to end by complementary coarse pitch screw-threaded stubs and sockets, the string, at its end remote from the drill bit, being connected, in manner known per se, to means for supplying energy to the drill bit. The drilling assembly in the embodiment under discussion is adapted to operate percussively rather than, (or as well as) rotatively and the energy supply is provided by compressed air, which is supplied down the hollow drill string and operates a piston hammer arrangement, to be described below, acting on the drill bit.

FIGS. 1A and 1B show what is in effect the operative or active portion of the In the apparatus illustrated in FIGS. 1A and 1B, the drill bit comprises a head portion 20 and a shank 22. The head portion is of asymmetrical form, known per se in directional drilling apparatus, and is shown somewhat schematically in FIG. 1B. By way of example, apart from a series of ports, for the discharge of drilling fluid and/or air, or flutes or grooves disposed around the rearward part of the head portion and hard buttons or inserts of the kind conventional in percussive rock drills, (none of which features is shown in FIG. 1B), the head portion may have the general form of a body of revolution about the bit axis from which a portion has been sectioned along a plane oblique to the bit axis, defining a flat 30 extending to the front end of the drill bit and imparting a deliberate asymmetry to the bit. A passage 34 for air extends axially along the bit shank 22 from the rear (i.e. upper) end of the latter, and communicates, in the head of the bit, with passageways leading to discharge ports 35, 35A on the surface of the drill bit head, as shown. The effect of such asymmetry is that when the bit is being driven through material by blows applied by a hammer (see below) to the rear end of the drill bit, the asymmetrical configuration of the drill head results in a progressive deviation of the bore being drilled to one side or the other, depending on the orientation of the drill bit about its axis. Other forms of asymmetrical drill bit may be used, for example a drill bit which has the general form of an axially short cylinder with a domed end surface concentric with that cylinder, but with that short cylinder and domed end having their common axis of curvature arranged eccentrically with respect to the central axis of the drill bit shank, although generally parallel therewith. Such eccentric drill bits are known per se. The head could, of course, take other, e.g. convex, shapes.

The apparatus shown in FIGS. 1A and 1B has provision for supplying both compressed air and drilling fluid to the drill bit and so the drill bit 20, 22 illustrated in FIG. 1B has separate passages (see below) for supplying compressed air and drilling fluid to the bit, the compressed air passage opening onto a port 35 on the bit head and the drilling fluid passage opening onto drilling fluid ports 35A on the head of the drill bit. These ports are also arranged asymmetrically about the drill bit head. Thus, when the bit is being used to drill in fluid-erodable material, such as soil or other granular material, the drilling fluid under pressure or exhaust air from the hammer supplied to the bit removes material preferentially from one side of the axis of the hole being bored, assisting the deviation or steering of the bit to that side. By controlling the orientation of the bit and selective supply of fluid in this way, the route of the drilled hole can be controlled.

It will be understood that the shape of the drill bit head is represented in simplified schematic form in FIG. 1B.

Figure 7:
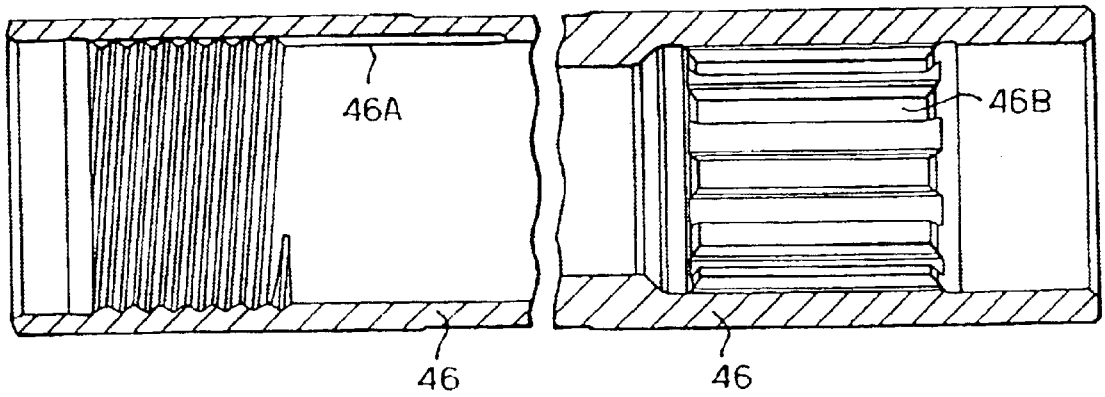
FIG. 7 is a fragmentary view in longitudinal section of the outer cylinder and chuck of the apparatus of FIGS. 1 to 6.

Referring again to FIGS. 1A and 1B, the drill bit shank 22 is received within a component referred to herein as a chuck 40 which is simply the forward end of an integral tubular cylindrical casing or sleeve 46 which effectively forms the forwardmost portion of the drill string. As best shown in FIG. 7, this sleeve 46 is internally screw-threaded at its rear (i.e. upper) end to receive an externally screw-threaded portion of a plug or adaptor 43, the rear (upper) end of which is provided with an internally screw-threaded socket to receive, in turn, a sonde section 48 of the apparatus, the sonde section 48 in turn having, at its rear (upper) end, the tapered, screw threaded stub 50 referred to above, which connects with the adjoining section (not shown) of the drill string. In this specification the "rear" or "upper" end of a part of the apparatus is that end which is furthest from the drill bit head.

Figure 4:
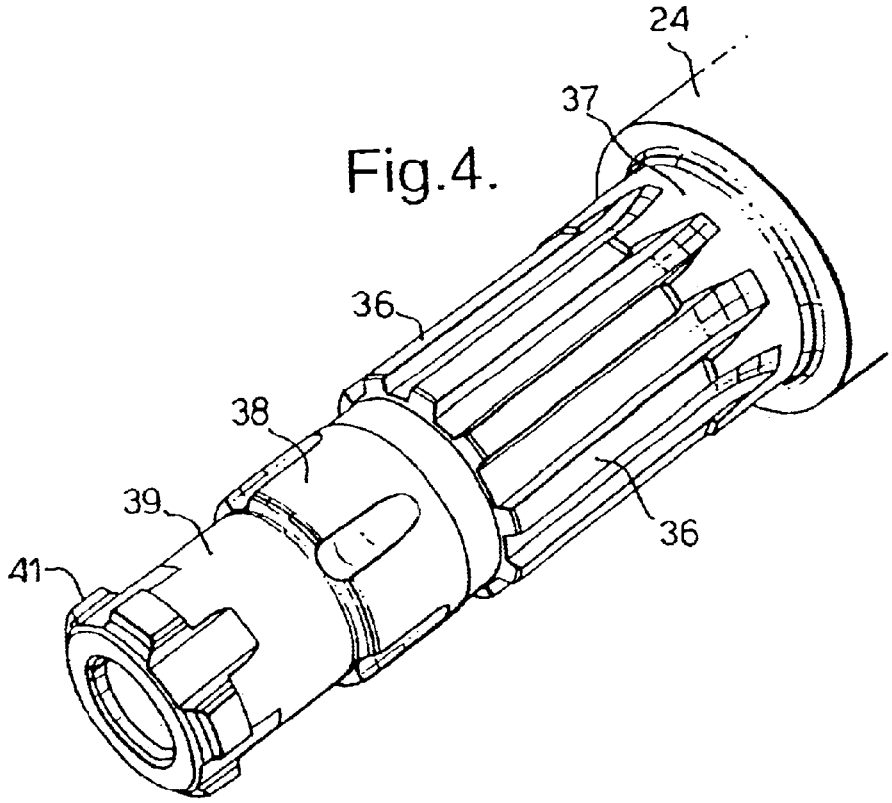
FIG. 4 is a perspective view of the shank of the drilling bit.
Figure 5:
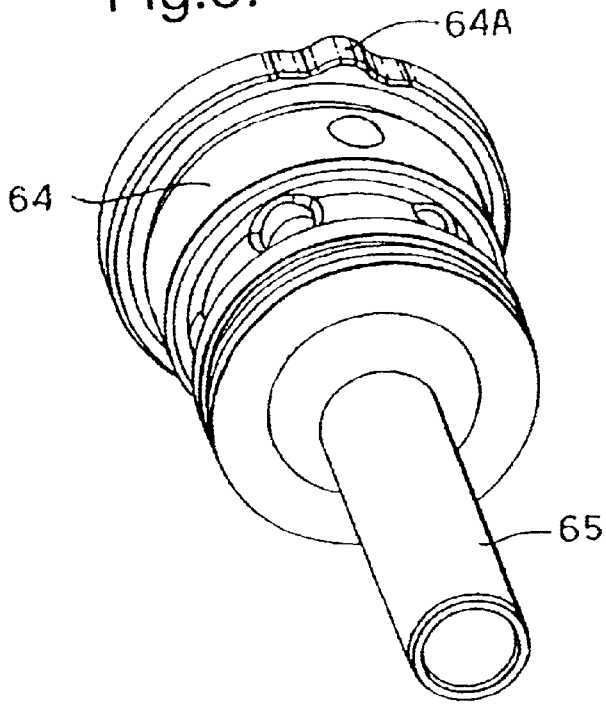
FIG. 5 and FIG. 6 are respectively a perspective view and an enlarged longitudinal section view of a stem body forming part of the apparatus of FIG. 1.
Figure 6:
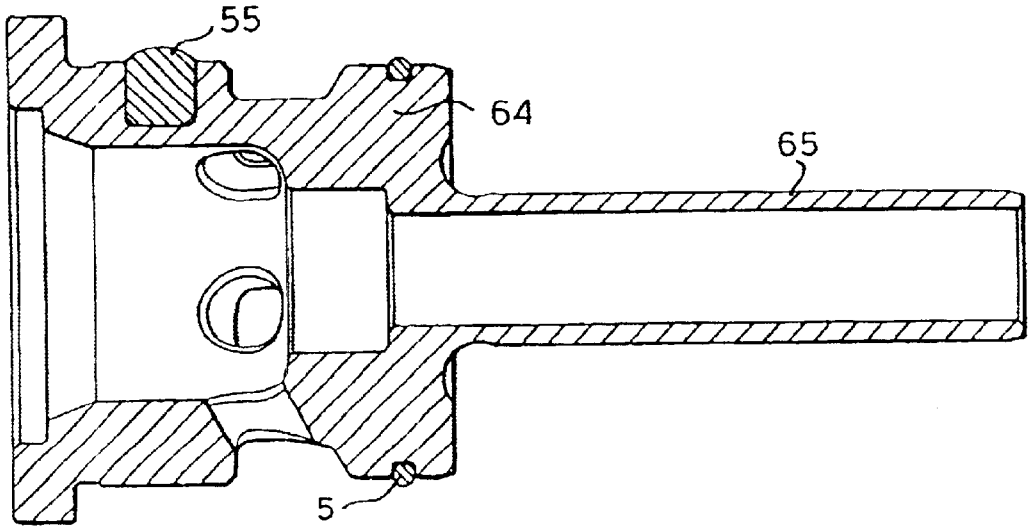

The shank 22 of the bit has a series of longitudinal splines 36 (see FIGS. 2 and 4) thereon and is received in a correspondingly internally splined passage or socket (46*b*—see FIG. 2) in a chuck 40 at the end of the drill string, whereby the drill bit is constrained against rotation relative to the chuck and drill string. As shown in the cross-sectional view which forms FIG. 2, the splines 36 are not completely regularly distributed around the axis of the bit, and since the grooves between the splines 46*b* of the chuck are arranged in the same way as the splines 36 on the shank 22, the shank 22 can be slid into the chuck in only one angular orientation. Thus, in the preferred arrangement illustrated in FIG. 2, the splines 36 are spaced apart at 35° intervals around the axis of the shank apart from the spline indicated at 36*b* which is spaced 40° from the adjoining splines 36 on either side. It will be understood that in variants, the angular spacing between splines may have any desired value and the splines may be in any desired number. Indeed, the drill bit and chuck need not be splined, specifically, but could, for example, be of polygonal cross-section. However, the complementary cross-sectional forms of the drill bit shank and the chuck should be such that the drill bit can be inserted in the chuck in only one angular orientation about the axis of the drill string. As shown in FIG. 4, an unsplined shank portion 37 is provided between the head portion 24 (shown only schematically in FIG. 4) and the beginning of the splines 36. As shown, the portion of the drill shank aft of the splines 36 is of stepped construction, comprising a plain cylindrical bearing part 38 of a diameter as small as or smaller than the diametral dimension measured across the grooves between splines 36, (although for manufacturing reasons or to assist in clearing debris, the surface of bearing part 38 may be interrupted by grooves as shown in FIG. 4), and comprising a second plain cylindrical part 39 aft of the part 38 and of still smaller diameter and which extends rearwardly to an axially short splined rear end part 41 of somewhat greater diameter than part 39 but still of smaller diameter than, or of the same diameter as, plain cylindrical bearing part 38 of the drill shank. As will appear below, the portion 38 and the further forward plain portion 37 of the drill bit shank constitute bearing surfaces.

Mounted within the sleeve 46 in substantially sealing relationship therewith, is a tubular, generally cylindrical liner 54 which forms the working cylinder for an annular-section piston 56 which acts as a hammer and, in operation of the apparatus in its percussion mode, repeatedly strikes the rear end of the drill bit shank to drive the drill bit into the material being drilled. The piston or hammer 56, in operation of the apparatus, is reciprocated by compressed air supplied alternately to opposite ends of the piston by a valving system which includes an arrangement of ports extending through the wall of the liner 54 and communicating with grooves on the exterior of the latter, in manner known per se, which grooves in turn define, with the adjoining surface of the cylinder 46, ducts for the compressed air which is supplied to said valving system from an annular chamber 57 just forward of adapter 43. The compressed air passes, via ports in a flange 63 of an upper fluids tube 74, via ports in a stem body 64, and via adjoining ports 58 in the liner 54, (FIG. 8) through a said longitudinal duct defined between the liner 54 and the sleeve 46, and through ports 59 in the liner 54 into an annular chamber 56A defined between the liner 54 and a central wasted portion of the piston 56. The piston 56 and the ported liner 54 together act as a kind of spool valve such that with the piston in its forwardmost position, (i.e. nearest the drill bit), the chamber 56A communicates with a port in the liner 54 which leads via a respective duct, to the forward end of the working cylinder, whilst with the piston 56 in its rearwardmost position, the chamber 56A communicates with a port in the liner 54 which leads, via a respective duct to the rearward end of the working cylinder. The stem body 64 has a forwardly projecting externally cylindrical and smooth spigot 65 which engages sealingly in the axial bore through piston 56 in the rearwardmost position of the latter to seal off the rear end of the working cylinder from the axial passage 66 through the piston, but which spigot is withdrawn from said axial passage 66 in the forwardmost position of the piston to allow air from the chamber at the rear end of the working cylinder to exhaust through axial passage 66 and through the central passage 34 in the drill bit and thence via ports 35 to the borehole being drilled. A bush 60 which is sealingly received within an enlarged end portion of the bore 34 extends axially rearwardly from the drill bit stem and engages sealingly in the axial passage 66 through piston 56 in the forwardmost position of the piston, to seal off the front end of the working cylinder from the axial passage 66 and from the bore 34 through the bit. In the rearwardmost position of the piston, the piston is clear of the bush 60, to allow air from the front end of the working cylinder to exhaust through the bush 60 and the bore 34.

In the arrangement illustrated in FIG. 1 provision is made for the supply of drilling fluid for the drill bit, such provision including a drilling fluid supply tube 32 which extends axially from the spigot 65, (which in this case is hollow to receive the tube 32), and which tube 32 extends with clearance through the bush 60 and the main part of passage 34 and at its forward end is a close sliding fit with a reduced diameter forward end portion of passage 34 connecting via a drilling fluid duct or ducts with a drilling fluid discharge port or ports 35A on the drill bit. Where no provision is to be made for the supply of drilling fluid to the drill bit, the tube 32 may be dispensed with and the spigot 65 made solid.

The bearing portions 37 and 38 of the drill shank are spaced apart significantly in the axial direction to resist as effectively as possible lateral tilting movement of the drill bit in the chuck.

Figure 8:
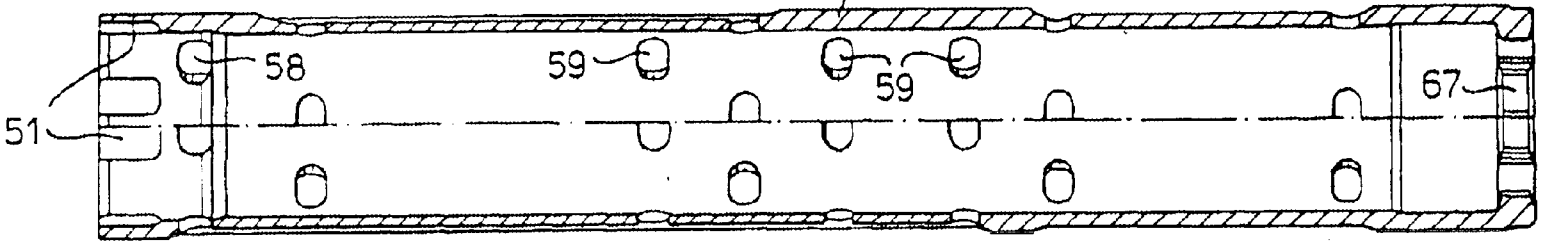
FIG. 8 is a view in longitudinal section view of a cylinder liner of the assembly, FIG. 8 showing above the longitudinal axis a section in one axial plane and below the axis a section in a different axial plane.

The stem body 64 is fixed against rotation in casing 46 (for a purpose described below) by a projection or key 64A at a predetermined location around its periphery which key 64A engages in a corresponding keyway or longitudinal groove 46A formed along the internal surface of the casing 46 adjacent the rear end of the latter (FIG. 7). The liner 54 is also fixed against rotation relative to the body 64 by a peg 55 projecting therefrom at a predetermined location around its periphery and which engages in one of several corresponding keyways or longitudinal grooves 51 formed along the internal surface of liner 54 adjacent the rear end of the latter. (FIG. 8). The body 64 thus prevents the liner 54 from rotating relative to casing 46. It is possible, by means of a special tool (not shown), to rotate the liner 54 about its axis within casing 46 through a limited angular range, when the adapter 43, fluids tube 74 and stem body 64 are removed, for a purpose to be explained below. Sealing means, such as an O-ring 55 etc., around the stem body 64, seals the latter with respect to the rear end of the liner 54.

As shown in FIG. 8, the end of the cylinder liner 54 adjacent the drill bit is provided with a radially inwardly directed flange which is interrupted at intervals by axially extending grooves to define five equally spaced splines 67. The splined rear end portion 41 of the drill bit shank (see FIGS. 1B and 4) is formed with five equally spaced, complementary outwardly projecting splines which correspond in cross-sectional size and shape with the grooves between the internal splines 67 at the end of the cylinder liner 54. That is to say, in the splined region 41 and in the region of the splines 67, the drill bit shank and the passage through the end of the cylinder liner 54, respectively, are of complementary cross-sectional form so that, with the splines at the end of the drill bit shank aligned with the spaces between the splines 67 at the end of the cylinder liner 54, the end of the drill bit shank can be extended axially into the end of the cylinder liner, with the splines on the portion 41 of the drill bit shank passing between respective adjoining splines 67 in the interior of the cylinder liner 54, the radially inner surfaces of the spleens 67 of the cylinder liner 54 cooperating closely with the cylindrical surface 39 of the drill shank end. A rotation of the cylinder liner 54, within member 46, through an angle, about its axis, corresponding to half the pitch between splines 67 will thereafter place the splines 67 in angular registry with the splines in region 41 of the drill bit shank, thereby thereafter preventing withdrawal of the drill bit shank and without a corresponding rotational movement in the reverse direction of the cylinder liner, (since the splines 36 further down the drill bit shank cooperate with the correspondingly splined region 46B (cf. FIG. 8) closely adjacent the forward end of the chuck 40, thereby preventing rotation of the drill bit relative to the chuck 40). Fitting of the drill bit in the manner described, and the indicated rotation of liner 54 within member 46 are carried out with member 46 unscrewed from adapter 43 and with fluids tube 74 and stem body 64 removed. The rotation of liner 54 referred to is effected by a tool which is extended through the rear end casing 46, and into the rear end of liner 54, the tool having lateral projections or ribs to engage in the grooves 51 in the liner. One of the grooves 51 will, of course, align with the internal groove 46A when the liner is in its position in which the splines 67 are in register with the splines on bit portion 41, and thus fully out of register with the grooves between splines of portion 41 and thus, because pin 55 is in alignment with key 64A on stem body 64, insertion of stem body 64 after such positioning of the liner locks the liner in position against rotation within casing 46.

It will, of course, be appreciated that the number of splines provided on any of the complementarily splined components described herein is of no particular significance and that numbers other than those specifically recited herein by way of example may be used. For example, if the bit shank has 12 splines, the number of locking grooves could be 6, 4, 3, or 2.

Because, as explained above, the drill bit shank can be inserted in the chuck 40 in only one orientation, the drill operator can keep a track of the orientation of the drill bit by keeping track of the orientation of a sonde mounted in sonde section 48 because, as explained below, the orientation of the sonde, about the drill string axis, relative to the casing 46, and thus chuck 40, is assured. The sonde is a device, known per se, which incorporates sensors, including sensors for sensing the orientation of the sonde, e.g. relative to the vertical and/or relative to the earth's magnetic field, and which also incorporates means for transmitting to the surface signals indicating the quantities sensed by the sensors, including signals indicating the orientation of the sensor. Thus, the sonde, (also referred to herein as a "data transmitter", transmits to the surface, by radio or some other means, (e.g. by ultrasonics) information as to the position, depth and orientation with respect to the vertical.

In the embodiment illustrated in FIG. 1 and featuring the drilling fluid supply tube 32, the tube 32 is sealingly engaged at its rear end in the hollow spigot 65 and in stem body 64. The bore through spigot 65 is part of an axial bore extending entirely through stem body 64 which communicates directly with an axial bore through upper fluids tube 74. The tube 74 has, formed integrally therewith, the aforementioned flange 63 which has, as shown in FIGS. 1A and 3, like stem body 64, longitudinal passages displaced laterally from the axis of the drill string, for thee supply of compressed air from chamber 57 to the liner 54.

Figure 3:
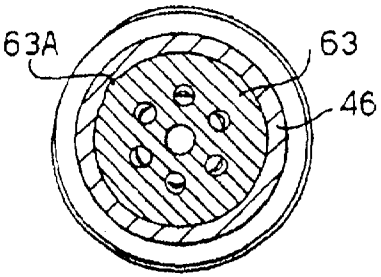
FIG. 3 is a view in cross section along the line III—III of FIG. 1.

Referring to FIGS. 1A and 3, the flange 63, which also fits closely within the rear end of sleeve 46, has key 63A projecting radially from its circumference, which also is received in keyway 46A (FIG. 7) and thus locates the fluids tube 74 in a predetermined angular position in sleeve 46 about its longitudinal axis.

Referring to FIG. 1, compressed air is supplied, through the drill string, to the chamber 56, via an annular passage 61 defined between the axial bore in the sonde section 48 and the exterior of a valve member 47 which is mounted on the fluids tube 74 for limited axial sliding movement and is rearwardly spring biased to engage a valve seat provided within sonde section 48 around the axial passage therethrough. The valve member 47 with said valve seat, thus forms a check valve for the compressed air supply to the bit. This check valve could, of course, be placed elsewhere in the assembly.

The sonde section 48 also acts as a housing for sonde 100, (see below). The sonde section 48, with the components contained therein is herein referred to as the sonde section, or the data transmitter section, of the drill string. The sonde section 48 is so contrived as to allow passage of compressed air from an axial passage through connector to at the rear end of sonde section 48, past the sonde, to the aforementioned check valve, (and also, where provision is made for the supply of drilling fluid, for the supply of drilling fluid from the rear end of sonde section 48 to the fluids tube 74 and thence to the tube 32). Thus, in the arrangement of FIGS. 1A and 1B in which a drilling fluid supply is also provided, the adapter 49 has central drilling-fluid supply tube extending from the stub 50 and is so contrived as to provide a fluid passageway, separate from that provided for compressed air, extending from the last-noted drilling fluid supply tube to the axial bore through member 74. Similarly, each other section (not shown) of the drill string includes a central tube or passage for drilling mud, and a generally concentric passageway for compressed air defined generally between such central tube and the outer structure or casing of that section. Each said other section of the drill string further includes spider-like structures supporting the respective central tube from the exterior structure. It will be understood that the rearward end of each drill string section may thus be configured similarly to the rear end of the assembly shown in FIG. 1A and that the forward end of each such drill string section may have central drilling mud tube contrived for sealing engagement with the drilling fluid tube at the rear end of the sonde section 48 or the corresponding component of the rear end of the adjoining drill string section, whereby a drilling fluid passage and a separate compressed air passage extend through the hole length of the drill string.

Where no provision is made for drilling fluid, the members 65 and 74 may be made solid, rather than as tubes, and the configuration of the internals of sonde section 48 may be correspondingly simplified.

Figure 2:
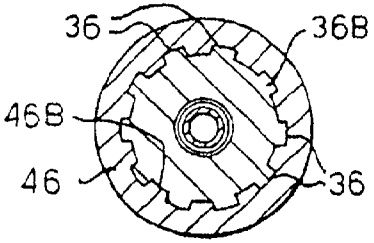
FIG. 2 is a view in cross section along the line II—II in FIG. 1.

It should be appreciated that the sonde section of the apparatus between the tube 74 and the threaded spigot 50 and including the sonde, and sonde housing, are shown only schematically in FIGS. 1 and 2, and, in particular, are shown as being much shorter than is actually the case.

Figure 10:
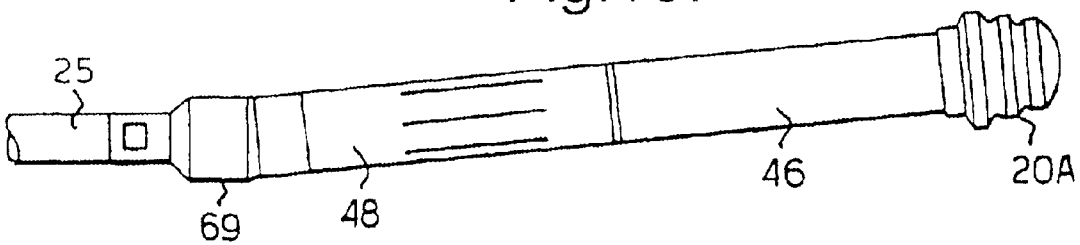
Figure 11:
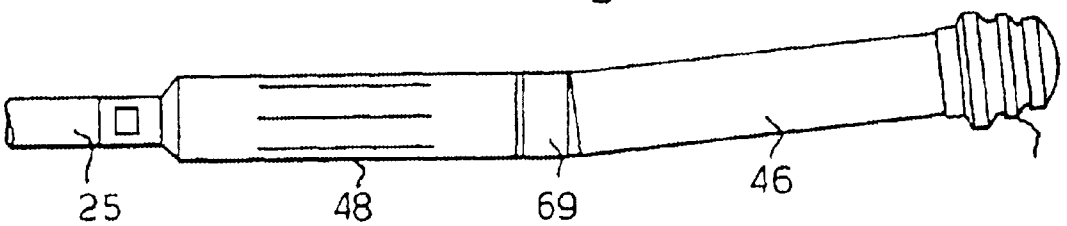
Figure 9:
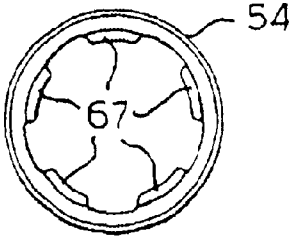
FIG. 9 is an end elevation view of the liner of FIG. 8, FIGS. 10 and 11 are diagrammatic side elevation views of another form of drilling apparatus in accordance with the invention.

Referring to FIGS. 10 and 11, instead of utilising a drill bit which has a head which is in some way asymmetrically disposed in relation to the longitudinal axis of the drill shank, for example being of "duck bill" form, as shown in FIG. 1B, or being eccentric with respect to the drill shank axis, the drilling apparatus may be made steerable by incorporating a slightly bent section 69 in the drilling string adjacent to, but spaced from the drill bit. By way of example, this bent section may be placed either at the rear of the hammer section/drill section assembly, as shown in FIG. 10, or between the hammer section 46 and the transmitter or sonde section 48, as shown in FIG. 11.

In FIGS. 10 and 11, the drill bit head is referenced 20A and the rearward (upper) part of the drill string is referenced 25. During drilling, the whole assembly may, for example, be rocked through, for example, 60 degrees to either side of the direction in which it is desired to steer.

Figure 12:
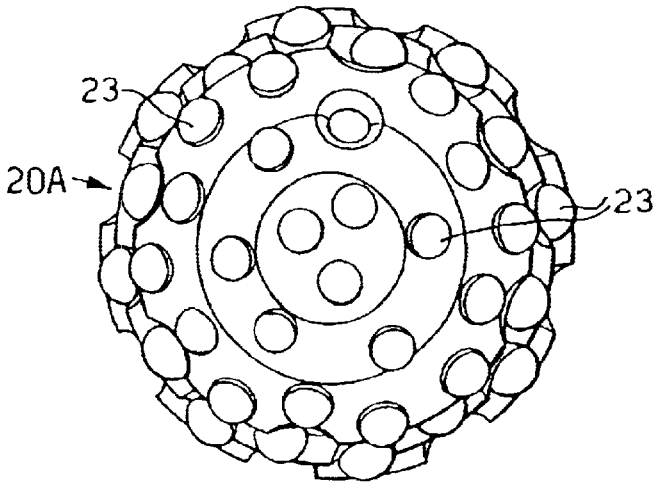
FIG. 12 is an end view of a drilling bit in accordance with another aspect of the invention.
Figure 13:
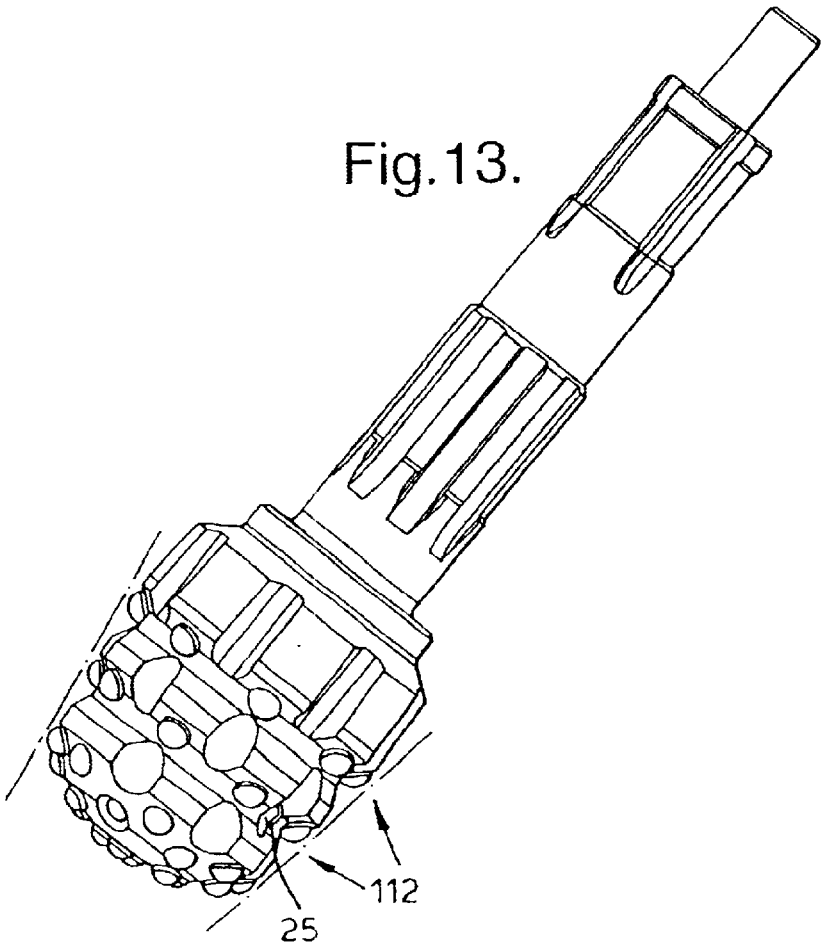
FIG. 13 is a side view of the drilling bit of FIG. 12.

In the arrangement of FIG. 10 or FIG. 11, since the bent section 69 is responsible for the steering, the drill bit need not be configured asymmetrically and need only be designed for the task of creating the hole. Attention in drill bit design can thus be concentrated on the minimisation of drill bit snag. FIGS. 12 and 13 show a drill bit according to another aspect of the invention in which this has been achieved, creating a drill bit that presents cutting tips (e.g. inserts) to all the rock at the end of the bore, despite the limited rotation applied to the drill. On ordinary rock drilling bits, in order to present cutting tips to all the rock at the end of the bore, the drill bit must be rotated 360 degrees. The drill bit shown in FIGS. 12 and 13, however, has the following features:

(a) The drill bit 20A is designed such that, within the given arc or rocking motion, cutting tips (provided, for example, by hard inserts 23) are present to all the rock to be removed. Thus, for example, if the drill bit is to be rocked through 90 degrees to each side of the direction of steer, the drill bit is designed in two segments about a centre (diametral) axis; each segment being provided with enough cutting tips 23 to remove all the rock in its arc of rocking. For rocking 60 degrees to each side of the steering direction the bit is designed in three segments, as illustrated in FIG. 12, and so on.

(b) As shown in FIG. 12, the bit is formed with its cutting tips 23, (provided, in the usual way, by hard carbide inserts) arranged in a series of concentric rings or tiers, with the inserts 23 of each row overlapping, i.e. being angularly displaced, about the central longitudinal axis of the drill bit, with respect to the inserts of the adjacent tiers or rows. This allows a more progressive entry of the bit into the rock and reduces the propensity of the bit to snag in the impression left by the bit in the rock.

(c) The drill bit is designed with one or more waisted regions 112 (FIG. 13) disposed rearwardly of the front face of the bit, and cutting tips or inserts 23 are provided also around the forwardly facing shoulders on the bit surface at the back of each such waisted portion, these cutting tips or inserts likewise being arranged to overlap, in angular position about the drill bit axis, the inserts of the adjacent tier of inserts to the front and/or to the rear. Furthermore, the bit has air exhaust ports 25 (corresponding in function with the ports 35 in FIG. 1B) which are located at the bottoms, (i.e. the radially innermost regions) of the respective waistings 112 of the bit, so that these ports are shielded from occlusion by the wall of the bore being drilled, by the wider portion of the drill bit in front, and are thus not easily blocked. Correspondingly located discharge ports for liquid drilling fluid, eg. drilling mud may be similarly located.

It will be understood that whilst the inserts 23 closest to the centre on the end face of the bit 20A in principle should pass through the whole extent of the respective sector (which is the minimum angle through which the bit is designed to be rocked, in use), the inserts 23 further from the centre are more closely spaced angularly and thus each of these will, in use, sweep through a corresponding sector which will, however, also overlap substantially the corresponding sectors of adjacent inserts 23 in the same ring or tier.

Since, in the arrangement of FIGS. 10 to 13, the orientation of the drill bit is not a factor in determining the direction in which the drill steers, it is not necessary to ensure any particular angular orientation of the drill bit in the drill chuck, and thus there is no need for the irregular distribution of cooperating splines discussed above in relation to asymmetrical steerable drill bits.

Likewise, it will be understood that the mechanism described above for drill retention in the chuck, utilising partial rotation of liner 54 in sleeve 64, may also be employed in the arrangements of FIGS. 10 to 13, whether irregularly distributed drill shank splines are used or not, and may also be employed in non-steerable, non-directional drilling apparatus, and so in apparatus without the irregularly distributed bit shank splines. This allows the percussive tool, i.e. the pneumatic hammer, to continue running, even when it has been thrust with too much force into softened materials, or predrilled rock.

Figure 14A:
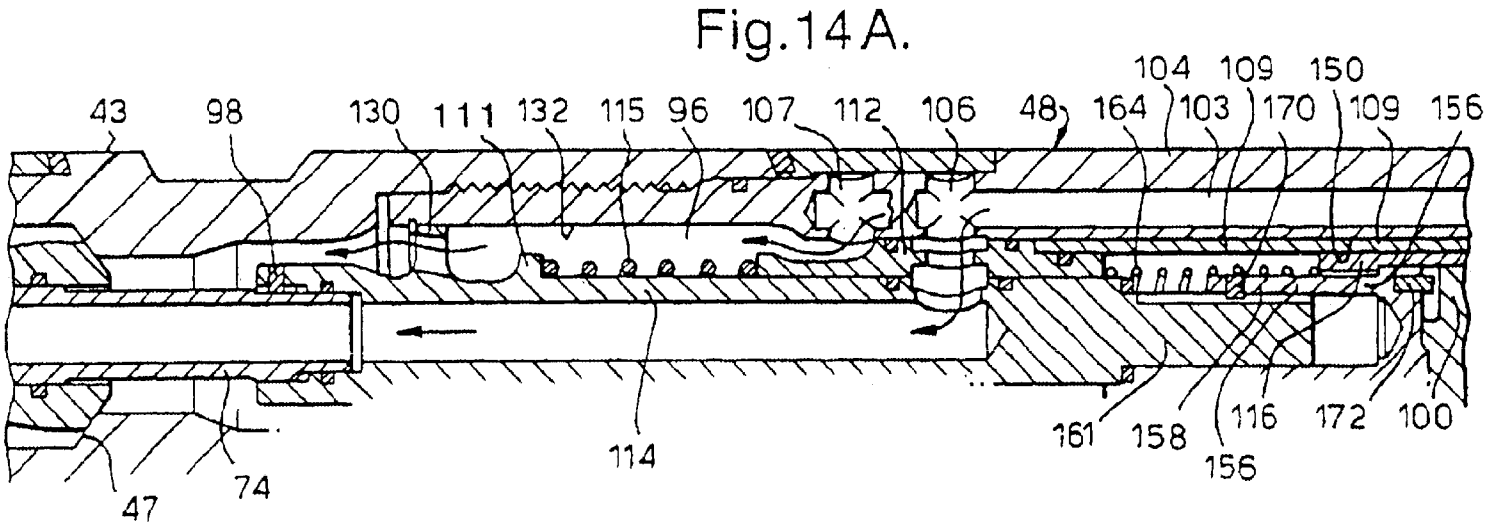
FIGS. 14A and 14B are respective parts of a partial axial section view, to an enlarged scale as compared with FIG. 1, of part of the assembly of FIG. 1 having a sonde.
Figure 14B:
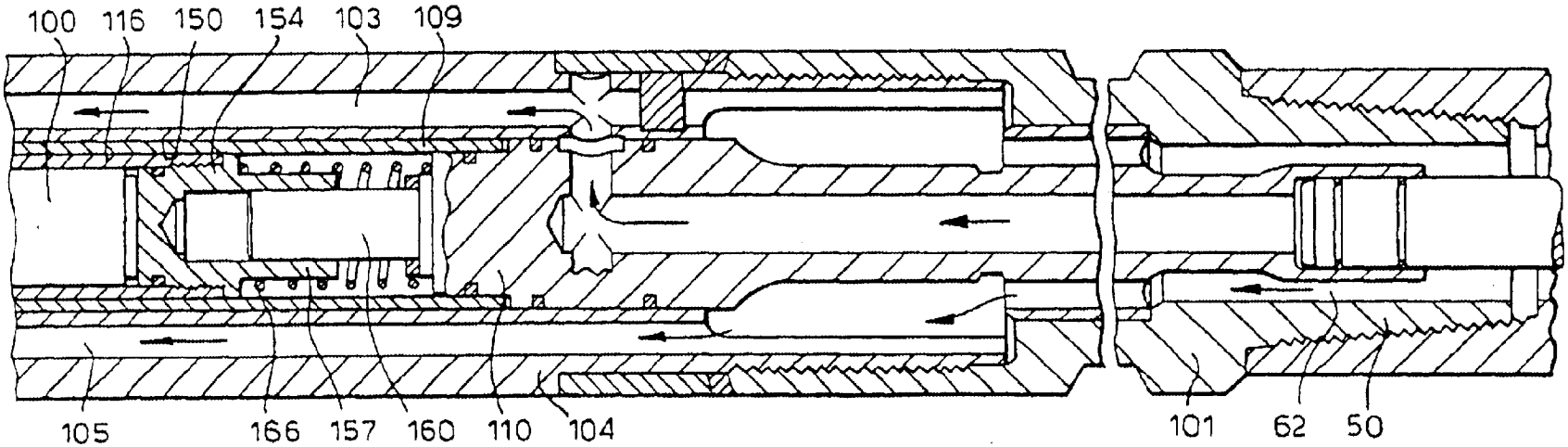

FIGS. 14A and 14B are adjacent palls of a partial view, in axial section, and to an enlarged scale as compared with FIGS. 1A and 1B, showing the sonde section 48 in more detail, in a practical embodiment, corresponding to the arrangement described with reference to FIGS. 1 to 9. FIGS. 14A and 14B each show the respective part of the drill string extending from the circumference on one side to the central axis and pail of the remainder from the central axis toward the other side. Thus FIGS. 14A and 14B are each slightly more than "half-axial" section views.

FIG. 14A shows a portion of sonde section 48 and associated parts closer to the drill bit and FIG. 14B shows a portion of sonde section 48 and associated parts further from the drill bit. For convenience FIGS. 14A and 14B are together referred to below as "FIG. 14".

Referring to FIG. 14, the complexity of the structure shown is largely due to the fact that a multi-componenit construction is appropriate from the point of view of ease of construction. In essence, however, in the arrangement shown in FIG. 14, the components 101 and 104 are, in use, substantially permanently fixed with respect to each other and may be regarded as forming the outer wall of the sonde section 48 of FIG. 1 which is releasably screwed into the adaptor 43 of FIG. 1A. Likewise, components 110, 12, to be referred to are, in use, normally permanently fixed with respect to the components 101 and 104.

The upper part 101, 104, is connected with the part of the drill string above it by a conventional coarse pitch screw such as is used conventionally to connect adjoining cylindrical or tubular sections of a conventional drill string together for rapid connection and disconnection, and the sonde section 101, 104, is likewise connected to the adapter 43 by a similar coarse pitch thread. (The representation of the components 48, 43 in FIGS. 1A and 1B thus does not show accurately, or indeed to scale, the arrangement shown in more detail in FIGS. 14A and 14B. The upper part 101, 104 and the components within it may conveniently form a sonde or data-transmitter section 48 of the drill string quickly detachable, by means of the coarse-pitch threaded connections referred to, from the hammer/bit section 46, below and from the drill string parts immediately above.

This data-transmitter or sonde section 48 of the drill string defines:

(a) a central space within which is accommodated a sonde assembly described below, (b) a passage for compressed air from the upper end of the data-transmitter or sonde section to the lower end, which passage extends alongside the region of the adapter accommodating the sonde and (c) (where there is provision for the supply of drilling fluid (drilling mud)) a similar passage for drilling fluid from the upper end of the data-transmitter or sonde section to the lower end which drilling fluid passage likewise is laterally displaced from the region of the adapter accommodating the sonde and is separate from the passage for the compressed air.

In addition, the arrangement to be described serves to maintain the sonde or data-transmitter in a predetermined rotational orientation, about the longitudinal axis of the assembly, with respect to the fluids tube member 74. It will be recollected that the member 74, like the stem body 64, has a collar or flange 63 which fits closely within the upper end of the sleeve 46 and is fixed in a predetermined angular position therein.

As shown in FIG. 14B, the component 101 provides the outer housing part and coarse-threaded connector 50 at the upper end of the sonde section (data-transmitter section) of the drill string. A drilling fluid tube 110, fixed within component 101, is adapted to connect with the central drilling fluid tube of the next rearward part of the drill string and provides a central fluid passage, closed at its lower end and communicating with a laterally displaced longitudinal duct 103 through an intermediate part 104 of the sonde or data-transmitting section, at the lower end of which the passage 103 connects via a lateral port 106, with an annular groove around an insert 112 fixed within part 104, and, via radial holes through the wall of insert 112, in the base of this groove, with a corresponding annular groove around an azimuth shaft 114. The last-noted groove communicates, via a port in shaft 114, with an axial bore in shaft 114 for the supply of drilling fluid to the fluids tube 74. The forward end of this axial bore in shaft 114 is counterbored to receive as a snug sliding fit, the rear end of fluids tube 74 and has an internal annular groove accommodating a sealing ring for sealing engagement with the rearward end of tube 74. A zenith pin 98, fitted in the forward end of shaft 114, projects radially into the outer counterbore for engagement in a longitudinally extending slot in a collar on tube 74, which collar is received in that counterbore as a free sliding fit. The pin 98 and the slot receiving it are part of the system provided for ensuring angular orientation of the sonde (see below).

Compressed air is supplied to the sonde or transmitter section 48 of the drill string via an annular space 62 defined between component 101 and the exterior of tube 110 and through an offset longitudinal duct 105 in component 104 (different from the duct carrying drilling fluid) and through a radial bore, (indicated at 107) into an annular space 96 defined within a bore 132 in a forward (i.e. lower) portion of intermediate part 104, between the wall of bore 132 and the azimuth shaft 114 passing through part 104, and thence passes to the next section of the drill string.

The azimuth shaft 114 has a collar 130 which is a sliding fit within the bore 132 in the forward (lower) end portion of component 104 and the compressed air from annular space 96 passes through longitudinally extending apertures in collar 130, to the check valve having valve member 47. The azimuth shaft 114 further has an elongated generally cylindrical stem portion which extends as a close sliding fit within a complementary axial bore in component 112. Azimuth shaft 114 is urged forwardly by a compression spring 115 acting between a further collar 111 on shaft 114 and a forward end face of component 112, forward axial movement of the component 114 being limited by abutment of the collar 130 with a circlip engaged in an internal groove at the forward end of bore 132. As noted above, the intermediate part 104 is screwed via a coarse-pitch thread, into the rear (upper) part 43, of the next (lower) drill string section, i.e. of the hammer/drill bit section. The part 43, inter alia, provides the valve seat with which valve 47 (see also FIG. 1) cooperates.

Received within a cylindrical central bore 150 in intermediate part 104 is a cylindrical tubular sonde housing casing 109, for example of plastics, which in turn receives, as a rotating and sliding fit, a cylindrical tubular sonde carriage 116 containing the sonde 100. The various components of the sonde are housed in a cylindrical casing or body which fits closely within sonde carriage 116. These components include, for example, the sensors, electronic circuitry, power supply battery, etc. making up the sonde. Such sondes are known per se and the sonde is therefore not described in detail herein. The tubular sonde carriage is closed at either end by respective plugs 154, 156 between which the sonde 100 is located. The plugs 154, 156 each comprise a respective tubular extension 157, 158, of reduced diameter with respect to the sonde carriage 152, extending axially therefrom, each such extension having an axial blind bore extending from its free end remote from the sonde and which receives as a free axial sliding fit, a respective cylindrical shaft 160, 161. In the case of the plug 154 at the end of the sonde carriage further from the drilling head, this cylindrical shaft, referenced 160, is provided by or fixed to the component 110 and the plug 154 is rotatable therein about the drill string axis whilst in the case of the plug 156 nearer to the drill bit, the shaft 161 received slidably therein is a rearward extension of the azimuth shaft 114. Because the assembly comprising the sonde carriage 116, sonde 100 and plugs 154, 156, is, in principle, axially slidable on the shafts 160, 161, the plugs 154, 156, are also referred to herein as slides, and the plug 156, for a reason which will become evident, specifically as the zenith slide. This sonde assembly is biased towards a central position, midway along the sonde housing 109 by compression springs 164, 166, at either rend, the compression spring 164 acting between the sonde assembly and an annular shoulder provided at the rearward end of component 112, around the bore through which the component 114 extends, and the spring 168 acting between the rearward end of the sonde assembly and an annular shoulder provided at the junction of the shaft 160 with the adjoining portion of component 110. The housing 109 is located axially within the bore 150 by, at the forward end of said bore, a rearward portion of component 112 fitted sealingly within the housing 109 and, at the rearward end of bore 150, by a forward end portion of component 110 likewise fitting closely within the housing 109. The resilient mounting of the sonde assembly within the housing 109 serve to minimise the transmission of possibly harmful shocks to the sonde assembly. If desired, a measure of gas or fluid damping for longitudinal movement of the sonde assembly in the housing 109 may be provided by a gas (e.g. air) or liquid contained within the housing 109 around the sonde assembly between the components 110 and 112. Alternatively, or additionally, damping may be provided by friction between the sonde carriage 116 and the casing 109. Longitudinal grooves or passages may be provided on the exterior surface of the sonde carriage 116 or on the internal surface of the bore in housing 109 to allow controlled transfer of fluid from behind the sonde assembly to in front of it and vice versa in order to dissipate energy. Instead of the sonde carriage being in the form of a tubular body encompassing the sonde in its entirety, the function of the sonde carriage could be fulfilled by two end caps, each placed over a respective end of the sonde.

Because the sonde is sensitive to its orientation with respect to the vertical, as well as to its depth (since it senses and relays these parameters to a receiver at the surface), it is important that reliable means be provided for fixing the orientation of the sonde, about the longitudinal axis of the drill string, relatively to the corresponding angular position of the drill bit. It will be recollected that the fluid tube 74 has an annular collar 63 from which projects radially, in the same way as the key 64A projects from the annular collar on the stem body 64, a key 63A which fixes the angular orientation of the fluid tube 74 with respect to the drill bit. As noted above, the zenith pin 98 at the forward end of shaft 114 is received in a longitudinally extending slot or keyway in the end portion of tube 74, whereby the angular orientation of the component 114 with respect to the drilling bit is maintained. Likewise, the rear end 161 of shaft 114, slidably received within the axial bore in zenith slide 156, is provided with a longitudinal slot or keyway receiving a zenith pin 170 fixed in the tubular part of the zenith slide 156 and projecting rearwardly inwardly into said keyway.

Accordingly, the angular orientation of the zenith slide about the longitudinal axis of the drill string is fixed with respect to the drill bit. Finally, the sonde body itself is provided, at its end adjoining slide 156, with a radially extending slot or recess which receives an off-set longitudinally extending zenith pin 172, to ensure the angular orientation of the sonde itself with respect to the plug or zenith slide 156 forming the respective end of the sonde carriage. It will be understood, of course, that orientation of the shaft 114 with respect to tube 74, or of the shaft 114 relative to zenith slide 156, need not be achieved specifically by pins and slots but could be by means of any complementary formations which allow interengagement in only a single orientation about the axis of the drill string. In addition to being slidable longitudinally along the sonde housing 109, the sonde carriage 116 is also rotatable, in the sonde housing 109, about the longitudinal axis of the drill string.

The provision made for longitudinal sliding movement of the azimuth shaft 114 relative to component 104 (and thus relative to sonde section 48 as a whole) is provided to allow the shaft 114 to be displaced resiliently rearwardly by the rear end of the tube 74 as the sonde/transmitter section of the drill string is screwed into the rear (upper) end 43 of the hammer section of the drill string, until the zenith pin 98 comes into angular alignment with the keyway or slot in the rear end of tube 74, at which point, of course, the spring 115 urges the shaft 114 forwardly and thus urges the zenith pin along the slot in tube 74. Because the shaft 114 is rotatable about its longitudinal axis with respect to the part 104, and hence with respect to the whole casing 104, 101 of the sonde/transmitter drill string section (albeit that such rotation is resisted by significant frictionally forces), during screwing together of the part 104 and the part 43, after the zenith pin 98 has engaged in the longitudinal slot in the end of tube 74, the shaft 114, and with it the zenith slide 156 and the sonde carriage 116, with the sonde itself, are fixed rotationally with respect to tube 74 and rotate within housing part 104 as the hammer section of the drill string is screwed onto the sonde/transmitter section (or alternatively remain stationary with the hammer section as the sonde/transmitter section is screwed onto the hammer section). By this means, it is ensured reliably and automatically that the sonde 100 has a predetermined orientation, about the drill string axis, with respect to the drill bit, (since the tube 74 has a predetermined angular orientation, about the longitudinal axis of the drill string, with respect to the housing 46 and the bit has a predetermined angular orientation with respect to housing 46).

It will be understood that, where no provision is to be made for the supply of drilling fluid, the arrangement may be simplified, with the shaft 114 being made solid, the annular space 106, bore 103 and the rearward tubular extension of component 110 omitted. In this case, also, the fluids tube 74 will be replaced by a solid reference member. (The tube 74 forms a reference member with respect to shaft 114 which forms an azimuth member).

Figure 17:
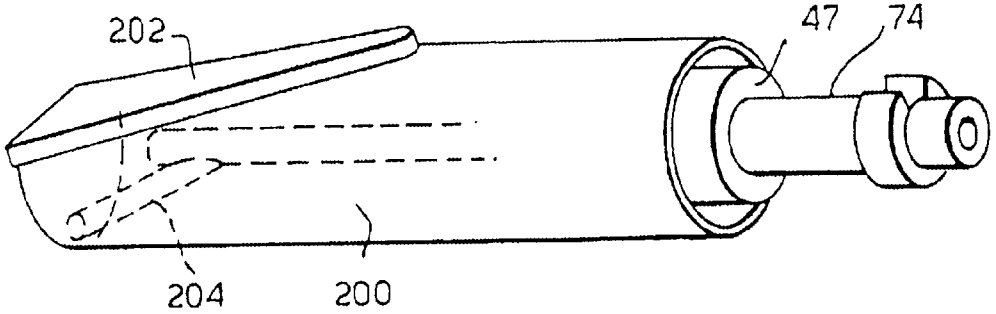
FIG. 17 is a schematic perspective view of a hammerless drilling device which may alternatively be used with the sonde housing illustrated in FIGS. 14A and 14B.

The sonde arrangement described above may be used also in directional drilling devices not incorporating a hammer, such as may be used, for example, in directional drilling in materials which can readily be displaced or eroded by jets of high pressure liquid. Thus, for example, FIG. 17 illustrates schematically a hammerless directional drilling bit or device of the last-noted character which is adapted to be screwed directly onto the sonde 48 in place of the housing 46, hammer assembly, and drilling bit 20 of FIGS. 1 to 14B. Thus the device of FIG. 17 comprises a generally cylindrical body 200 having an oblique flat 202 extending along one side to the front end of the device and a fluid jetting port 204 (illustrated schematically in broken lines) opening onto the front end face at a location spaced from the oblique flat. At its rear end, the device of FIG. 17 has a configuration corresponding substantially to the rear end of the housing 46 and adapter 43 and carriers, internally, components corresponding to components 47 and 74 in the embodiment of FIGS. 1 to 14B, for similar engagement with the complementary components at the front end of the sonde section 48, the fluid tube 74 or its counterpart in FIG. 17, thus having a collar with a longitudinally extending azimuth slot to receive the zenith pin 98 in the forward end of shaft 114 in the sonde section 48. Since the device of FIG. 17 is hammerless, compressed air is not required to operate a hammer and thus the device of FIG. 17 need not have internal passages communicating with the compressed air passages in the sonde section 48. Alternatively, where supply of compressed air to the front end of the drilling device of FIG. 17 may assist in excavation of the material to be drilled, such compressed air passages may be provided and may open onto corresponding ports at the front end of the drilling device.

Figure 15:
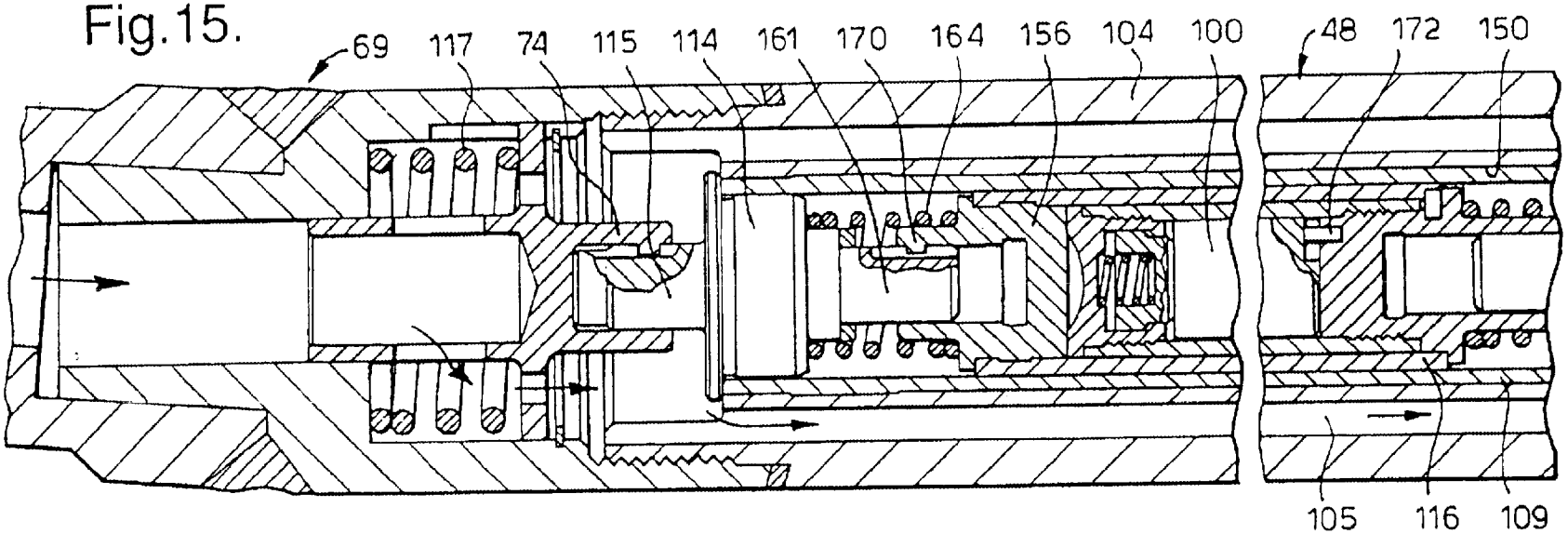
FIGS. 15 and 16 are corresponding sectional view of corresponding parts of the drilling apparatus of FIGS. 10 and 11 respectively.
Figure 16:
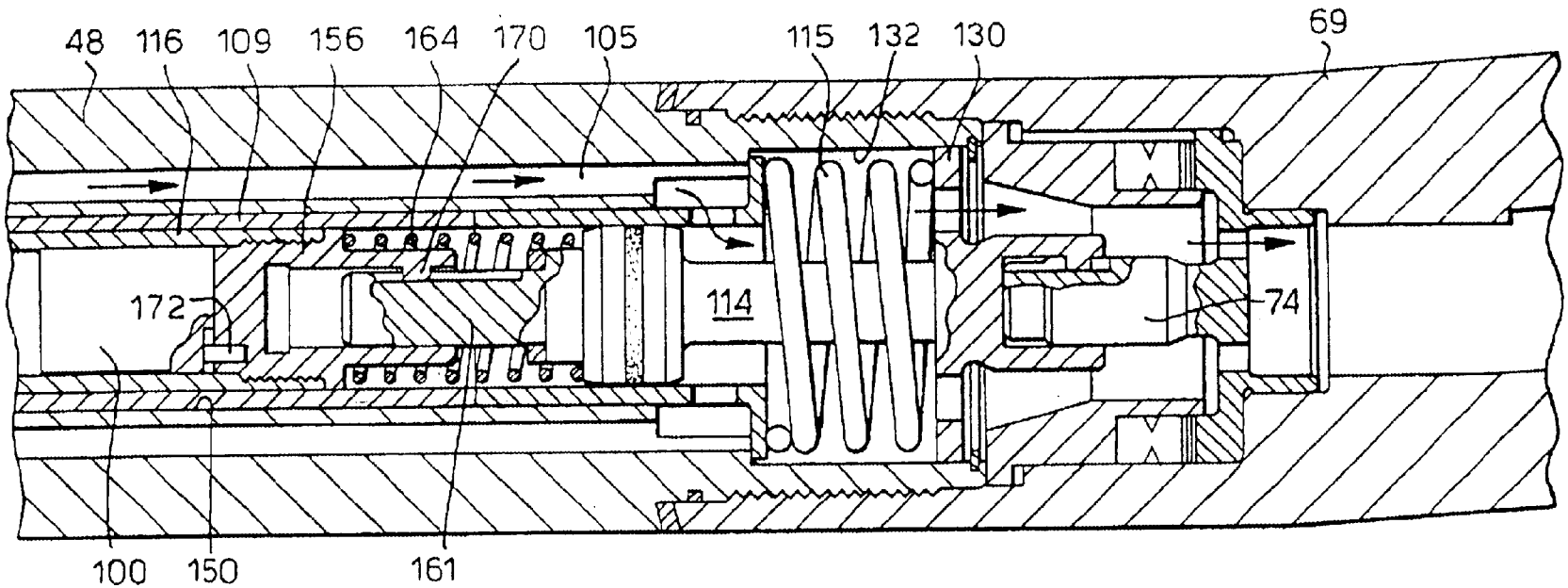

FIGS. 15 and 16 are sectional views illustrating the application of automatic alignment arrangements in accordance with the invention to the variants illustrated in FIGS. 10 to 13 utilising a so-called "bent sub" instead of an asymmetrical drill bit. In such variants, of course, it is the orientation of the bend or angle in the bent sub with respect to which the sonde 100 is required to adopt reliably a predetermine orientation. Thus, referring to FIG. 16, in which components corresponding in function to components in FIGS. 14A and 14B have like references, an alignment finger 74 fixed in the hammer section which incorporates (below the region holding the finger 74—i.e. nearer the drill bit than the region holding finger 74) the sub bend 69, cooperates with azimuth shaft 114 which, as in FIG. 14A, has a grooved stem 161 slidable in, but non-rotatable in a zenith slide 156 of the sonde carriage 116, which again is rotatable in the sonde housing 109. The azimuth shaft 114 is again rotatable, against significant frictional resistance, in the sonde or data transmitter housing 48. An alternative arrangement is shown in FIG. 15, in which the bent section 69 is located above, (rearwardly of), the sonde section 48 and the hammer section. In this case an alignment or reference member 74, again carried by and non-rotatable with respect to the bent section 69 provides a tube or socket which extends downwardly (forwards), to receive a solid plug or spigot portion 115 of an azimuth shaft 114 extending upwardly into that socket. The portion 115 has a longitudinal groove receiving a pin projecting radially inwardly into the socket of the alignment or reference member 74 so that, again, when the azimuth member 114 is fully engaged with the reference member 74, the azimuth member is slidable longitudinally with respect to the reference member 74 but is non-rotatable with respect thereto. The sonde carriage, disposed below the azimuth shaft 114 again has zenith slide 156 located, in this case, at its upper end and again cooperating non-rotatably with the shaft 161, (downwardly-projecting, in this case), of the azimuth shaft, the azimuth shaft 114 and sonde carriage 116 again being rotatable in the casing 109 and hence in the outer housing of the sonde section 48 of the drill string. In this arrangement, simply by way of illustration, the azimuth shaft is not significantly movable axially in the sonde section of the drill string, but is fixed in the end of the sonde housing 109 and the alignment or reference member 74, whilst being non-rotatably supported in the bent section 69, is displaceable therealong, against the force of a biasing spring 117 along the longitudinal axis of the sonde section, (i.e. along the axis of the lower part of the bent section 69 which screws onto the sonde section 48 below). It will be understood that in FIGS. 14 and 16 likewise, the element 74 could be displaceable axially against spring pressure but non-rotatable, with the azimuth shaft 114 being rotatable without being axially displaceable. Likewise, in these embodiments, the member 74 might provide a socket to receive the end of the azimuth shaft instead of the latter providing a socket to receive the reference member 74.

In each of the arrangements of FIGS. 15 and 16, compressed air to operate the hammer is led through the section 48, past the sonde housing, through longitudinal passages 105 offset from the central axis of the section 48, just as in the arrangement of FIG. 14 and the reference member 74 in FIGS. 15 and 16 has ports to allow air to pass into (in the case of FIG. 16), the section downstream of (below) section 48 or, (in the case of FIG. 15), from the section upstream of (above) the section 48. As in FIG. 14, corresponding provision may be made for the supply of drilling mud or other drilling fluid to the bit, in a manner similar to that described in relation to FIG. 14.

What is claimed is:

1. A drilling apparatus comprising a series of elongate sections releasably interconnected end to end by interengaging screw threads, orienting means for ensuring that a first component carried by a first of said sections adopts a predetermined orientation with respect to a second component carried by, or forming part of, an adjoining section said section when the first and second of said sections are screwed together, wherein said first component is rotatable with respect to said first section and wherein the first section carries an azimuth member, which is rotatable with respect to said first section but is non-rotatable with respect to said first component, and wherein the second section carries a reference member which is fixed against rotation relative to said second component and is engageable with said azimuth member in a predetermined angular orientation relative to the azimuth member as said first and second sections are screwed together end to end, and wherein, when so engaged relative rotation about the axis of said sections, between said azimuth member and said reference member is precluded by such engagement, and wherein one of said azimuth member and said reference member is resiliently displaceable away from the other as said first and second sections are screwed together, whereby during an initial phase of screwing said first and second sections together the resiliently displaced member can be displaced axially, to counteract the progressive approach of said first and second sections, as the latter are screwed together, whilst rotating relative to the other said member, until said predetermined angular orientation of the reference member with respect to the azimuth member is reached, allowing the azimuth member and reference member to engage and thereby prevent further relative rotation between the two, whereby the azimuth member, and said reference member coupled thereto, will maintain said predetermined orientation relative to said second component despite further rotational movement between said first and second sections during completion of the screwing together of said first and second sections.

2. A drilling apparatus according to claim 1 wherein said azimuth member is subject to frictional resistance to such rotation with respect to said reference member.

3. A drilling apparatus according to claim 2 wherein one of said azimuth member and said reference member has a spigot capable of fitting freely within a complementary socket carried by the other of said members, said spigot and socket being co-axial with the screw connections between said sections, and said spigot or said socket has a lateral projection adapted to slide longitudinally into a longitudinal groove in said socket or said spigot respectively.

4. A drilling apparatus according to any of claims 1 to 3 wherein said first component is a sonde and said first section is a sonde section housing said sonde, and wherein said second component is a directional drilling device, the sonde being mounted in the sonde section for sensing its own orientation and transmitting corresponding data to a receiver spaced from the drill string, and wherein said orienting means is provided for establishing a predetermined angular relationship between the directional drilling device and the sonde.

5. A drilling apparatus according to claim 4 wherein the sonde is mounted in the drill string via a resilient suspension arrangement to isolate the sonde from mechanical shocks.

6. A drilling apparatus according to claim 5 wherein said suspension arrangement includes fluid or frictional damping means.

* * * * *

UNITED STATES PATENT AND TRADEMARK OFFICE

CERTIFICATE OF CORRECTION

PATENT NO. : 6,705,415 B1
DATED : March 16, 2004
INVENTOR(S) : Alistair Micheal Faley et al.

It is certified that error appears in the above-identified patent and that said Letters Patent is hereby corrected as shown below:

Column 1,
Line 61, “spleens” should read -- splines --
Line 61, distribution of the said” should read -- distribution of said --.

Column 4,
Line 30, delete “FIGS. 1A and 1B show what is in effect the operative or active portion of the”.

Column 11,
Line 2, “pail” should read -- part --.
Line 11, “componenit” should read -- component --.

Column 15,
Line 27, “predetermine” should read -- predetermined --.

Signed and Sealed this

Seventeenth Day of August, 2004

JON W. DUDAS
*Acting Director of the United States Patent and Trademark Office*